United States Patent [19]

Graef et al.

[11] 4,313,601

[45] Feb. 2, 1982

[54] AUTOMATIC BANKING MACHINE WITH SEALED TAMPER-INDICATING CONTAINER FOR RECEIVING AND STORING DIVERTED PAPER MONEY BILLS

[75] Inventors: Harry T. Graef, Dover; Scott A. Mercer, Hanoverton; Jeffrey A. Hill, North Canton, all of Ohio; Spiro Leontas, Hesperia, Calif.

[73] Assignee: Diebold Incorporated, Canton, Ohio

[21] Appl. No.: 167,212

[22] Filed: Jul. 9, 1980

[51] Int. Cl.[3] ..... B65H 31/00

[52] U.S. Cl. ..... 271/207; 232/1 D

[58] Field of Search ..... 194/1 A, 1 B; 271/63, 271/198, 207; 232/1 D, 43.2

[56] References Cited

U.S. PATENT DOCUMENTS 4,113,140 9/1978 Graef ..... 221/6

4,154,437 5/1979 Butcheck ..... 271/6

*Primary Examiner*—Richard A. Schacher

*Attorney, Agent, or Firm*—Frease & Bishop

[57] ABSTRACT

A remote automatic banking or teller machine equipped with doubles detecting mechanism which diverts doubles from delivery to a customer and conveys the doubles to a container into which the conveyor means discharges the doubles through a container opening having closure means which are in open position when mounted on the dispenser unit in access-preventing or anti-fishing condition and which closure means are closed and locked to provide a sealed tamper-indicating anti-fishing condition for the container after the container is removed from the dispenser unit and during transport to a central bank.

8 Claims, 12 Drawing Figures

AUTOMATIC BANKING MACHINE WITH SEALED TAMPER-INDICATING CONTAINER FOR RECEIVING AND STORING DIVERTED PAPER MONEY BILLS

CROSS-REFERENCE TO RELATED PATENTS

The particular container and transport constructions and relationships comprise improvements on the construction shown in U.S. Pat. No. 4,154,437, dated May 15, 1979.

BACKGROUND OF THE INVENTION

1. Field of the Invention

The invention relates to automatic banking or teller machines (ATM's) and particularly to cash or paper money dispenser mechanisms for remotely located ATM's. More particularly, the invention relates to the construction and operation of a sealed tamper-indicating container and its coordinated relationship with transport mechanism which discharges bills into the container that have been diverted, among other reasons, for example, from delivery to a customer as a result of the detection of "doubles", such diverted bills being discharged from transport means, and received and stored in the container which is sealed in a tamper-indicating condition before it can be removed from the ATM.

It is desirable to control access to diverted bills by personnel servicing ATM's who may attempt to fish bills from the container while the container is locked to the unit, so as to eliminate the necessity of providing multiple personnel when servicing an ATM or while replenishing the supply of paper money bills with which the ATM is loaded, or while removing a rejected paper money bill container, and also to maintain the same high degree of protection for the removed diverted bills that is provided for the loaded bills.

2. Description of the Prior Art

Many types and kinds of ATM's are known in the banking field designed for installation and operation remote from a main banking headquarters. Such ATM's invariably are provided with devices which detect the presence of doubles being transported from the paper money supply to the cash delivery station of the ATM, and which divert such detected doubles and then transport the same to a collection zone within the ATM.

U.S. Pat. No. 4,154,437 shows a container which receives and stores diverted bills delivered by a transport mechanism to the container. The container thereof is locked before removal from the transport device to attempt to protect the paper money bills contained therein during transport to the main banking headquarters.

However, the construction and arrangement of transport conveyor and container in U.S. Pat. No. 4,154,437 does not provide sealed tamper-indicating conditions against fishing by servicing personnel while locked to the unit or while being transported to the main bank, because the diverted bills deposited in the container may be tampered with or fished from the container while unlocked and mounted on the unit, or after the container is locked and separated from its mounting on the unit. Thus the same degree of protection is not provided for the diverted bill container of U.S. Pat. No. 4,154,437 that is provided by the sealed tamper-indicating money dispensing container of the type shown in U.S. Pat. No. 4,113,140, with which the currency dispenser of U.S. Pat. No. 4,154,437 may be equipped.

Accordingly, there is a need existing in the art for a construction and arrangement which provide maximum security or at least the same degree of security in handling diverted paper money bills in their containers that is provided by a sealed tamper-indicating container construction and arrangement charged with a supply of paper money for loading the ATM.

SUMMARY OF THE INVENTION

Objectives of the invention include providing a sealed container construction for removable assembly with a cash dispenser unit of an ATM adapted to receive and store paper money bills, diverted by a doubles detector mechanism during operation of a cash dispenser, delivered by conveyor means extending between the point of diversion and the diverted bill container; providing such sealed tamper-indicating container and arrangement which includes mechanism preventing removal of the container from the cash dispenser unit without the container being locked in sealed tamper-indicating condition; providing such sealed tamper-indicating container construction and arrangement which prevents access to paper money bills diverted during cash dispenser operation during and after delivery to an opening in the container having closure means which must be closed and locked before removal of the container from the cash dispenser unit; providing such sealed tamper-indicating construction which protects the diverted bills from being fished from the container while mounted on the unit or during transport to a main bank headquarters; and providing such sealed tamper-indicating container construction and arrangement which achieves the stated objectives in a most efficient and highly secure manner, which is simple in construction and operation, and which satisfies needs existing in the field of automatic remote cash dispensing banking services.

Such objectives are obtained by the sealed tamper-indicating container construction, arrangement and operation generally stated as including in a cash dispensing automatic banking machine having a conveyor which transports paper money bills diverted from the normal path of travel to a conveyor divert discharge station, the combination of a container having walls forming a bill-receiving opening provided with a closure lid; lock means mounted on a container wall having bolt means located inside the container cooperatively connected with the closure lid for moving the closure lid from closed to open position as the bolt means is actuated from locked to unlocked mode, and vice-versa, and the lock means having a key opening accessible exteriorly of the container; key means including a key for the lock means movably mounted on and sealed to the banking machine; means for mounting and retaining said container in position on the banking machine oriented to telescopically receive in said key opening said key for unlocking said lock means, and when so oriented to locate the container opening and its said closure lid adjacent said conveyor divert discharge station; and shroud means mounted on the banking machine protectively enclosing said conveyor divert discharge station and said container opening and closure lid when the container is in retained oriented position.

BRIEF DESCRIPTION OF THE DRAWINGS

A preferred embodiment of the invention - illustrative of the best mode in which applicants have contemplated applying the principles - is set forth in the following description and shown in the drawings and is particularly and distinctly pointed out and set forth in the appended claims.

Similar numerals refer to similar parts throughout the drawings.

DESCRIPTION OF THE PREFERRED EMBODIMENT

Figure 1:
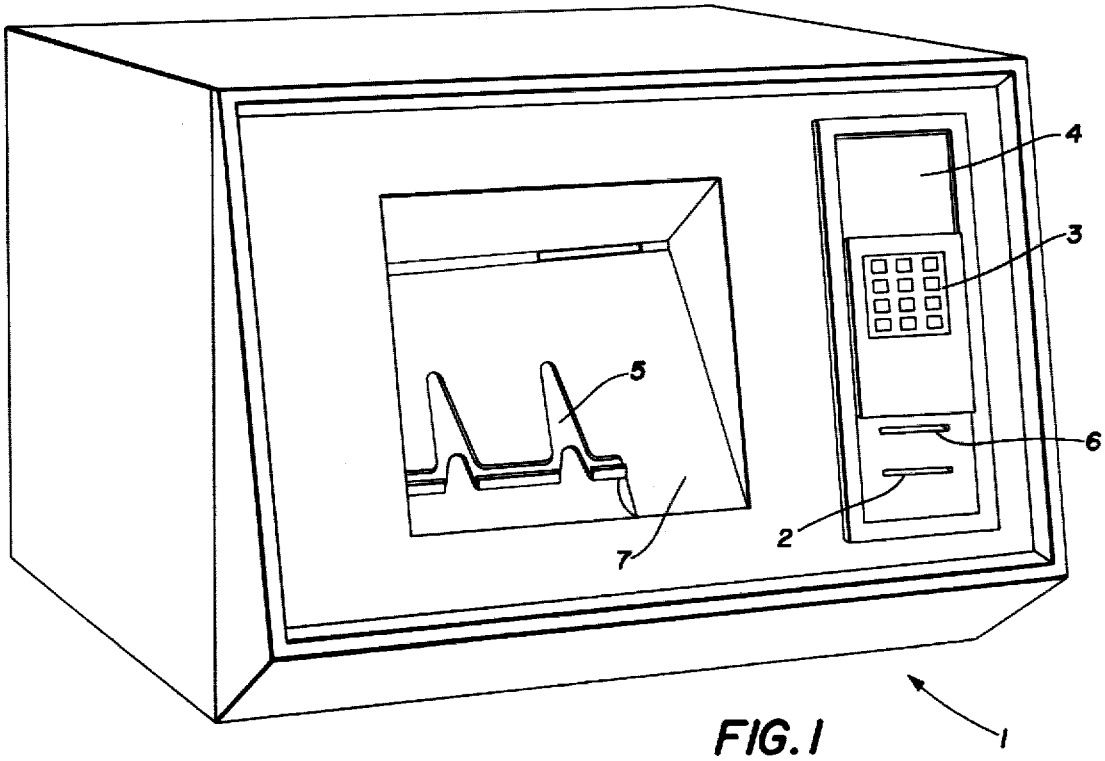
FIG. 1 is a somewhat diagrammatic perspective view of an ATM provided with currency dispenser means having doubles detect mechanism and provided with sealed tamper-indicating container means for receiving and storing paper money bills diverted by the doubles detect mechanism.

A typical ATM for dispensing currency in response to the presentation by a bank customer of coded card means is diagrammatically illustrated at 1 in FIG. 1. Such an ATM may be energized when a customer presents or enters a coded card into slot 2. The coded card is verified to confirm that it is an authorized card and that the user thereof is the authorized user, through a card reader and other known devices contained in the ATM 1 or electrically connected thereto.

After the card and customer verification has been carried out, keyboard entries may be made by the customer at 3 in accordance with instructions presented to the customer at instruction panel 4. The entries, among other matters, may indicate the amount of currency that the customer desires to withdraw, or may indicate that the customer desires to conduct another type of banking transaction.

If currency is to be dispensed, it may be delivered from dispenser mechanism within the unit 1 at the cash dispenser station or customer access bill delivery receptacle 5. A record of or receipt for the transaction may, in some instances, be issued to the customer through receipt slot 6. The card entry slot 2, the keyboard 3, the instruction panel which may be a TV screen 4, the currency delivery receptacle 5, and the receipt slot 6 all are preferably formed in or carried out by the recessed facia plate means 7.

Figure 2:
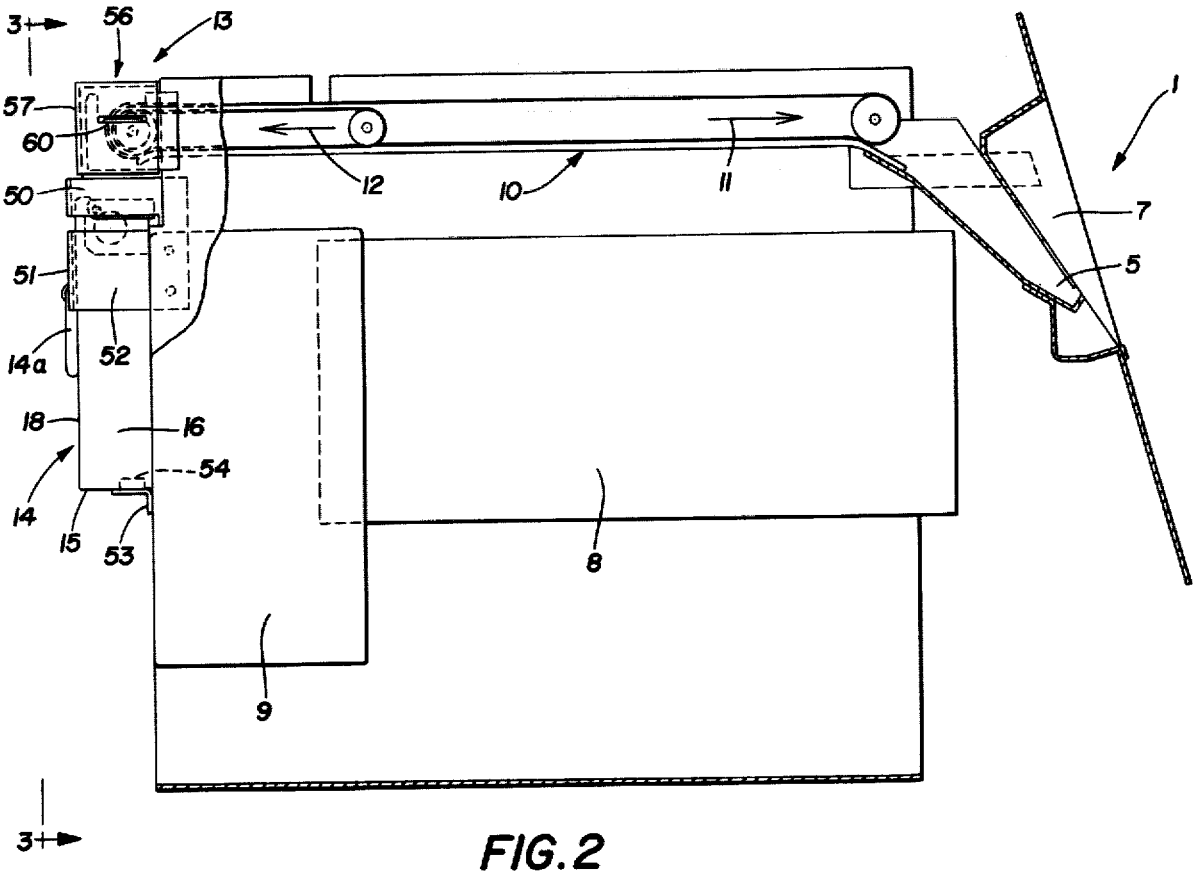
FIG. 2 is a diagrammatic side view illustrating typical components of an ATM having the improved sealed tamper-indicating container assembled therewith.
Figure 3:
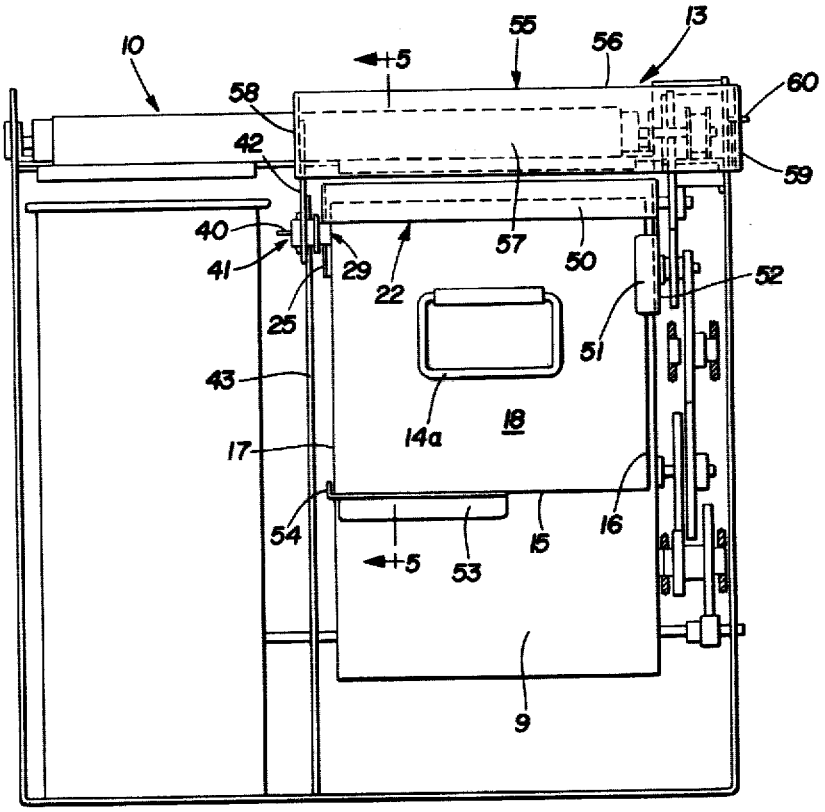
FIG. 3 is a diagrammatic view of the equipment shown in FIG. 2 looking in the direction of the arrows 3—3, FIG. 2.

Cash dispenser and possible related components are generally diagrammatically illustrated in FIGS. 2 and 3 and may include one or more containers 8 for supply stacks of paper money in the form of bills of one or more denominations protectively held in the container or containers 8. Such containers may be of the type shown in U.S. Pat. No. 4,113,140 wherein the containers are identified as sealed tamper-indicating money dispenser containers. Any desired number of such containers for currency of different denominations may be present in an ATM. The currency supply container or containers 8 have associated therewith picker mechanism diagrammatically indicated by the block 9 which may be any desired type of mechanism for picking paper money bills, one at a time, from a stacked supply and for feeding the same, bill by bill, to other components of the ATM.

The ATM components diagrammatically shown in FIGS. 2 and 3 may also include doubles detect mechanism, not shown but similar to such mechanism described in U.S. Pat. No. 4,154,437 over which the concepts of the present invention comprise improvements, FIGS. 1, 2 and 3 being generally similar to such views in U.S. Pat. No. 4,154,437.

As described in said U.S. Pat. No. 4,154,437, currency to be dispensed is delivered by the picker mechanism 9 to transport means, such as the belt conveyor generally indicated at 10, for delivery in the direction of the arrow 11 to the currency delivery receptacle 5. As the bills are conveyed from the picker 9 to the belt conveyor 10, the bills pass through a doubles detect zone which detects the presence of doubles. When doubles are detected, the belt conveyor 10 is reversed and the detected doubles are diverted from movement in the direction of the arrow 11, to movement in the opposite direction indicated by the arrow 12 to discharge the diverted bills at the divert discharge end 13 of the belt conveyor 10 and to deliver such bills to a container or receptacle.

The concepts of the invention relate to an improved container construction generally indicated at 14 and its cooperative and coordinated relationship with other components of the ATM 1. The container 14 (FIGS. 4, 5 and 6) is a boxlike receptacle having a bottom wall 15, end walls 16 and 17, and side walls 18 and 19. The side wall 18, at its upper end, has an inturned flange 20. The flange 20 and the upper ends of the side wall 19 and end walls 16 and 17 define a top opening 21 (FIG. 6) for the container 14 into which diverted bills are discharged by the divert discharge end 13 of the belt conveyor 10. The opening 21 is closed by a pivoted lid or cover member generally indicated at 22. The lid 22 has a top wall 23, a side flange 24, and end flanges 25 which are pivotally mounted at 26 on the end walls 16 and 17 of the container 14.

Figure 4:
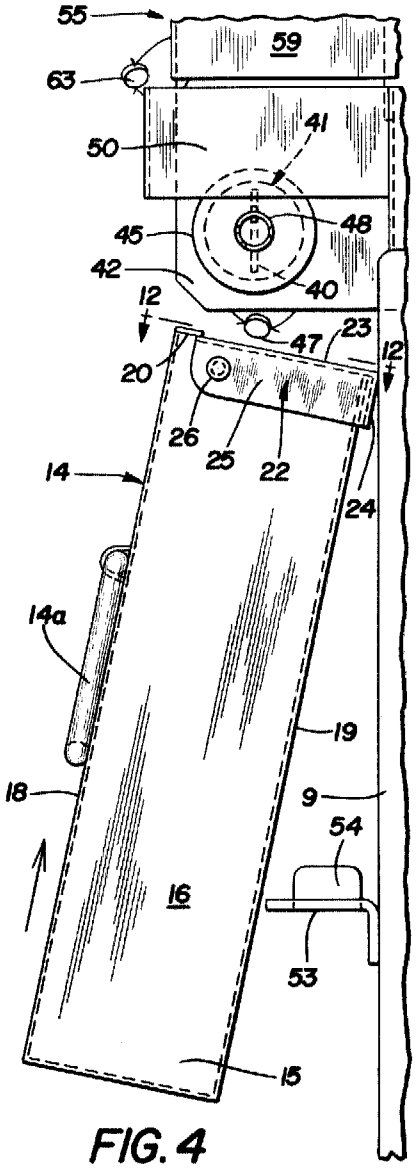
FIG. 4 is an enlarged side elevation with parts broken away of certain of the parts shown at the upper lefthand corner of FIG. 2, illustrating the improved sealed tamper-indicating container in locked condition being assembled with other components of the ATM.
Figure 5:
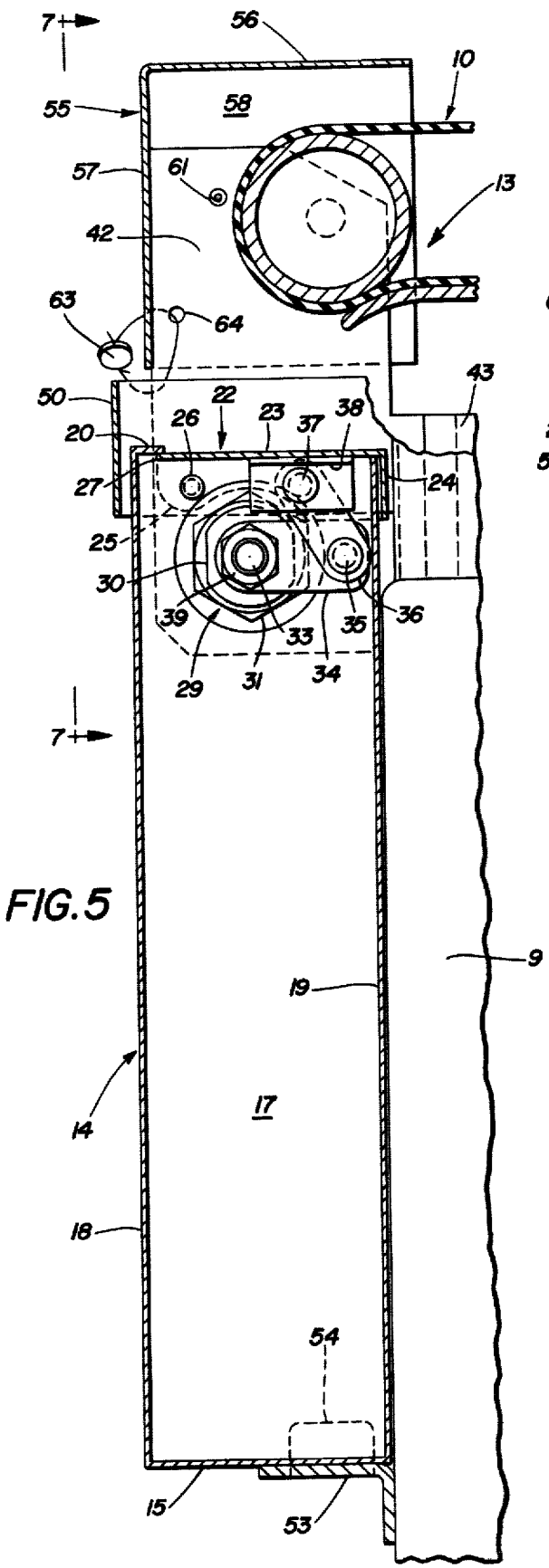
FIG. 5 is a further enlarged sectional view taken on the line 5—5, FIG. 3, similar to FIG. 4 showing the sealed tamper-indicating container assembled with components of the ATM with the container still in locked condition.
Figure 12:
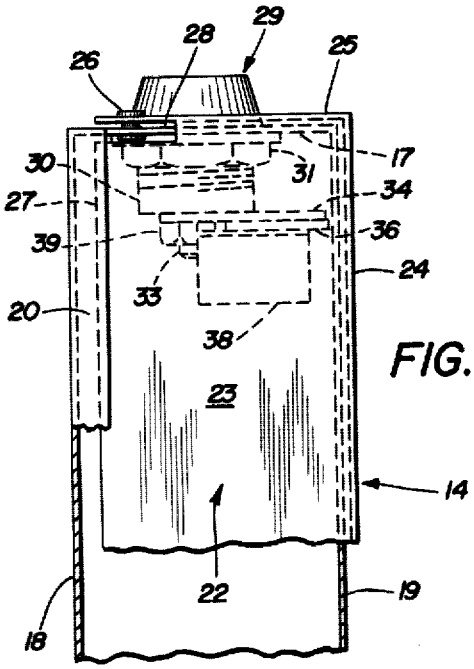
FIG. 12 is a fragmentary view of the top corner of the container with the closure in closed position looking in the direction of the arrows 12—12, FIG. 4.

The side and end flanges 24 and 25 of the closure lid 22 surround the outer upper ends of the container side wall 19 and end walls 16 and 17 while the side edge 27 of lid top wall 22 extends beneath the inturned flange 20 on container side wall 18 as well shown in FIG. 5. In order to permit the lid 22 to pivot between the closed position of FIG. 5 and the open position of FIG. 6, the top wall 23 is provided with slots 28 at each end thereof best shown in FIGS. 10 and 12. Thus, when the lid 22 is in the closed position shown in FIGS. 4, 5 and 12, the container 14 is completely closed and its contents are inaccessible from outside the container.

Figure 7:
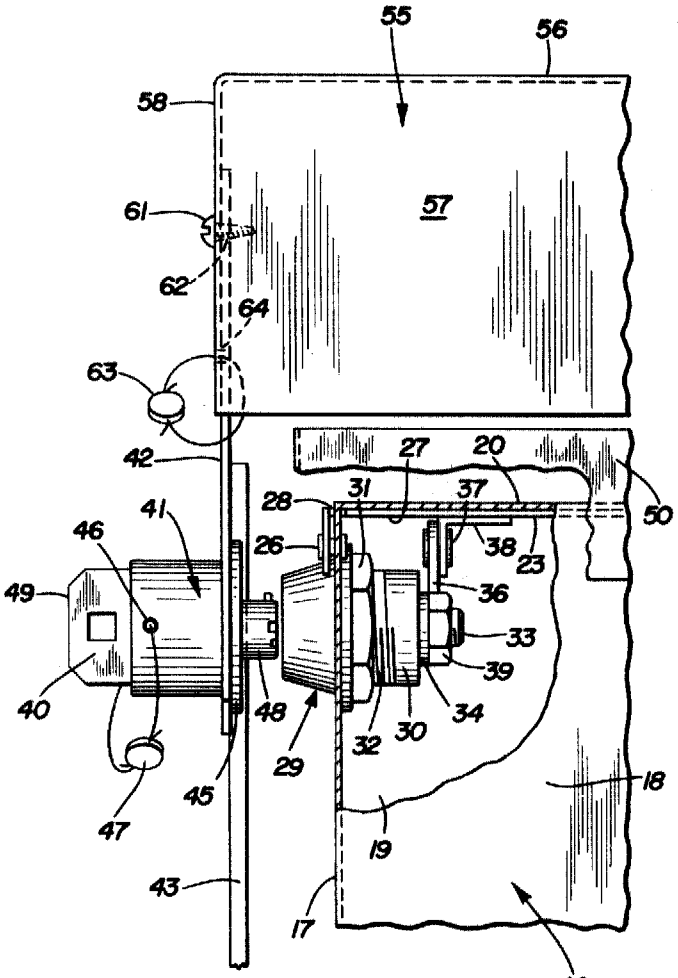
FIG. 7 is an enlarged fragmentary view with parts broken away looking in the direction of the arrows 7—7, FIG. 5 and showing the upper lefthand corner of the sealed tamper-indicating container and related protective devices as the container with its closure locked is being assembled with and locked to the ATM, and also showing the container lock in condition to receive a key for unlocking the container, sealed to the ATM.

The container 14 is provided with a lock 29 having a housing 30 mounted on and extending through the container end wall 17. The lock mounting means preferably includes a nut 31 in clamping threaded engagement with the threads 32 on the outside of the housing 30 (FIG. 7). Thus, the nut 31 is inaccessibly located inside the container when the lock 29 is locked with the lid 22 closed. The lock bolt 33 is a rotary bolt having a lever 34 (FIG. 5) mounted thereon. The outer end of the lever 34 is pivotally connected at 35 to a link 36 which is pivotally connected at its other end at 37 to an angle bracket 38 mounted on the inside of lid top wall 23.

Figure 8:
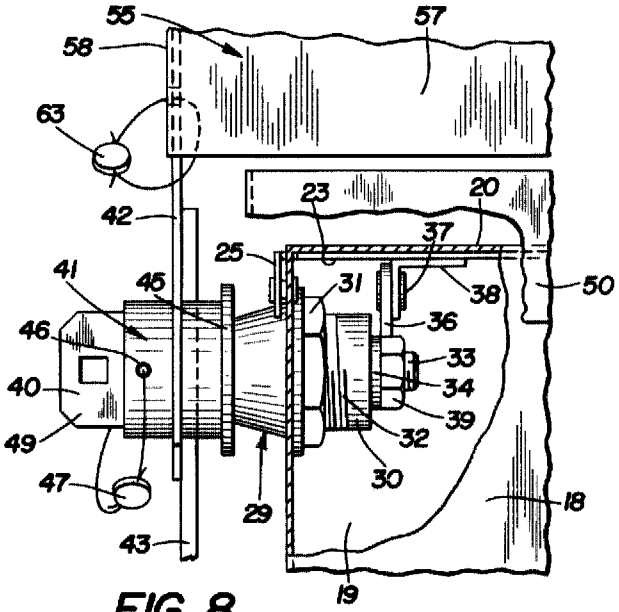
FIG. 8 is a view similar to FIG. 7 but showing the key engaged with the container lock and with the container closure still locked closed, as shown in FIG. 5.

The lever 34 is clamped to the lock bolt 33 by a nut 39 so that when the lock 29 is in locked condition or mode of FIGS. 5, 7 and 8, the lock bolt 33 through the lever 34 and link 36 holds the lid 22 locked in closed position. The lock bolt 33 is rotated to the unlocked position of FIGS. 6 and 9 when the lock 29 is unlocked, and the lock bolt thus through the lever 34 and link 36 moves the lid 22 to the open position shown. In this manner the lock 29 actuates the lid 22 to move it between closed and open positions as the lock is, respectively in locked or unlocked modes.

Figure 11:
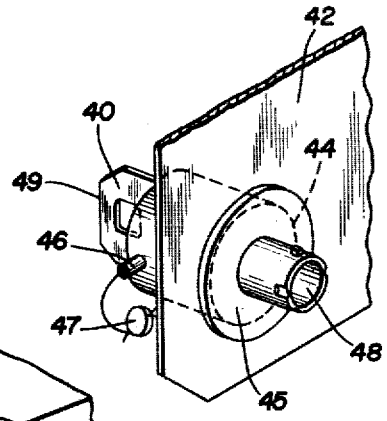
FIG. 11 is a perspective view of the parts shown in FIG. 10 looking toward the lock engageable end of the key.
Figure 10:
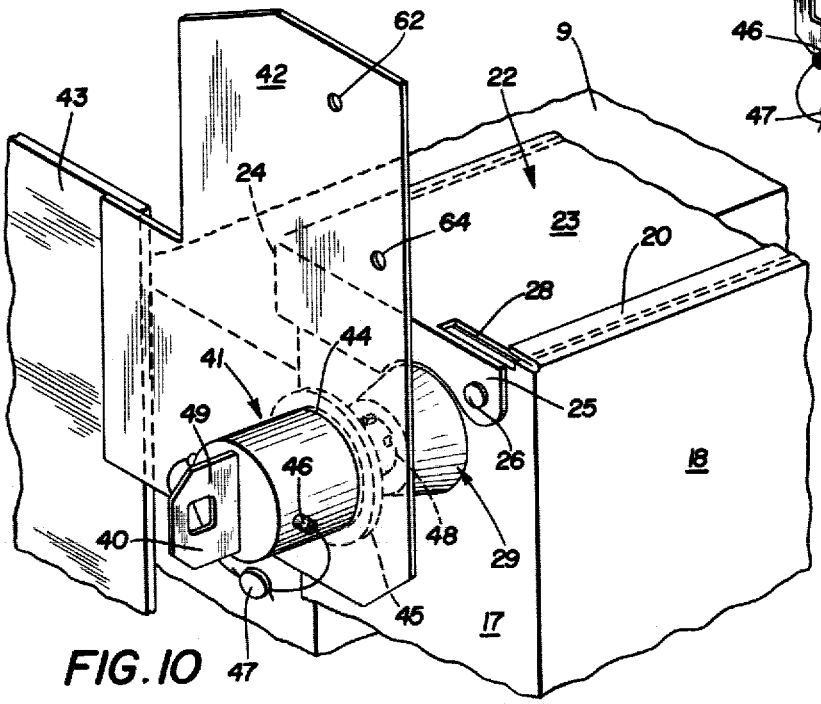
FIG. 10 is a fragmentary perspective view of the container key and key retainer in the position shown in FIG. 7.

The lock 29 is actuated or locked and unlocked by a key 40 mounted in a key retainer, generally indicated at 41, which in turn is mounted on a bracket plate 42. The bracket plate 42 may be fixed in any suitable manner to a frame plate 43 of the mechanism (FIG. 10). The key retainer 41 preferably may be a molded plastic member which extends axially and rotatably through an opening 44 formed in the bracket 42. The retainer 41 has a flange 45 formed at one end thereof (FIG. 11) which engages one face of the bracket 42 to prevent the retainer 41 from being removed from the bracket 42 by axial movement to the left in FIG. 7.

A hollow pin 46 extends through a hole drilled in the retainer 41 and through the key 40 (FIGS. 9, 10 and 11), and the ends of the pin 46 project beyond the outer cylindrical surface of the retainer 41, as shown, to provide stop means preventing removal of the key retainer 41 and key 40 from the bracket 42 by axial movement of the retainer to the right viewing FIG. 7.

The key retainer 41, key 40 and hollow pin 46 are maintained sealed in the condition shown against removal without indicating tampering, by a wire and lead seal 47, the wire extending through pin 46. However, the key retainer 41 and key 40 assembly when sealed captively in tamper-indicating condition to the bracket 42, may be rotated and axially moved to various rotated and axial locations within the opening 44 in bracket 42.

Key 40 has a hollow cylindrical lock barrel 48 projecting from the flanged end of the key retainer 41 and which is adapted to telescope into the housing 30 of a container lock 29 when the container is properly located and positioned with respect to the key retainer upon being assembled with the components of the ATM 1. When the lock barrel end 48 of the key 40 is telescoped into the housing 30 of a lock 29 when the lock 29 is in a locked condition or mode, the key 40 may be rotated to actuate the lock to unlocked condition, thereby unlocking a container lid 22 and moving the same to open position.

Figure 9:
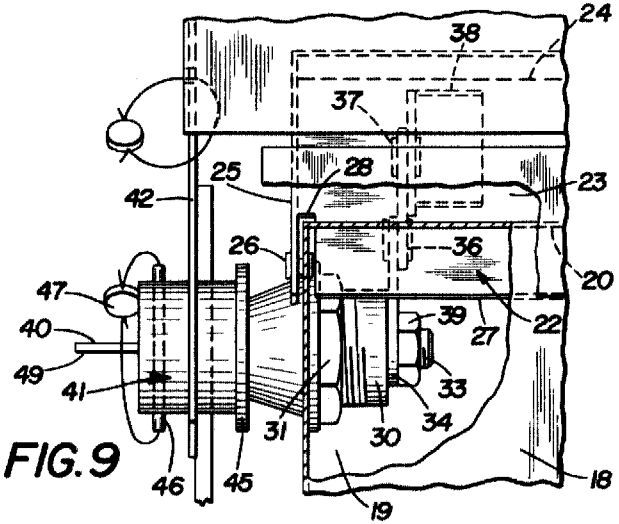
FIG. 9 is a view similar to FIGS. 7 and 8 but showing the key moved to a position to unlock the container lock and to open the container closure, as shown in FIG. 6.

Referring to FIGS. 7, 8, 10 and 11, the key held captive to the ATM unit has its handle portion 49 oriented vertically, as shown, to indicate that it is in a state whereby it may be telescoped by axial movement into a lock 29 which is in a locked mode. When the key 40 is thus telescoped into a lock 29 and rotated, the orientation of the key handle 49 is as illustrated in FIG. 9, indicating actuation of the lock 29 to an unlocked mode, and movement of the container lid 22 to open position, and locking of the container to the ATM, against removal.

In accordance with the concepts of the invention, the captive key 40 has only one other similar key for the lock 29. The second key is held at the central bank where the container 14 is unlocked and unloaded of diverted bills discharged into the container when open and locked to the ATM unit. This two-key control of the lock 29 of any container 14 provides the same degree of security for the container 14 that is provided for the supply of money in locked containers with which the ATM is charged, in accordance with the disclosure of U.S. Pat. No. 4,113,140.

An empty locked container 14 when brought by a security messenger to a remote ATM unit is assembled with the unit (assuming that a container 14 filled with diverted currency first has been removed from the unit in a manner described below) by moving it upward at an angle as shown in FIG. 4 to insert its upper end inside of a metal U-shaped retainer strap 50 mounted in fixed position as a part of the frame of the ATM cash dispenser unit. The container 14 may be manipulated by a handle **14*a* to insert the upper end of the container within retainer strap 50. During such insertion, the righthand end of the container 14 (FIG. 3) must be slipped behind the flange 51 of bracket 52 also mounted in fixed position on the frame of the unit. Container 14 must be raised to a position above bracket 53 on picker 9 so that it may be lowered onto bracket 53 on which the bottom wall 15 of container 14 rests and is held with installation is completed. Bracket 53 has an upturned flange 54 at its end which engages the container corner at the lower end of container end wall 17**.

Figure 6:
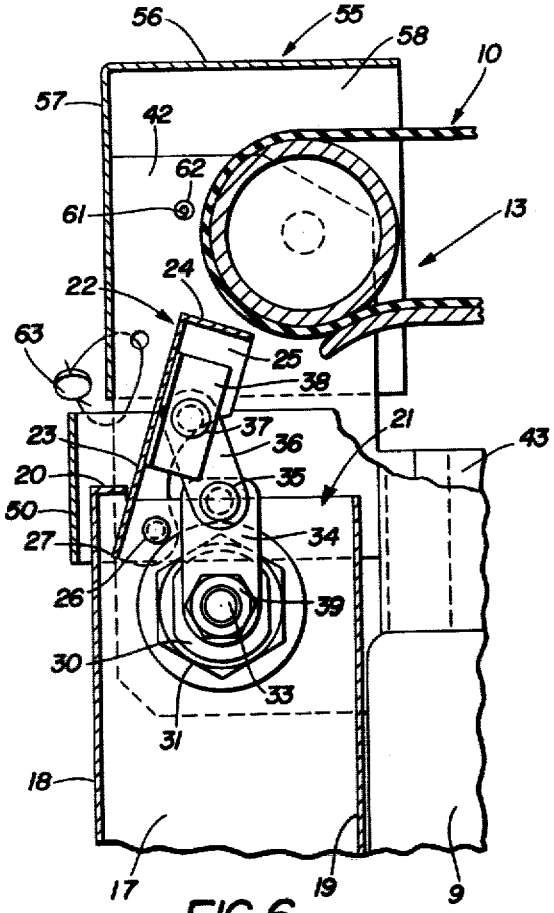
FIG. 6 is a sectional view similar to FIG. 5, but showing the container with its closure open and unlocked ready to receive diverted bills to be stored in the container.

In this manner the container 14 is properly positioned so that it cannot be moved to the right or left or downward, viewing FIG. 3, and the upper end of the container is trapped within the U-shaped retainer 50. The container so positioned as shown in FIG. 7 is located or oriented so that the key and key retainer assembly 40-41 may be moved axially to telescope the key lock barrel 48 into the container lock 29. The key in telescoped position is shown in FIG. 8 and at this time the key 40 may be rotated to the position shown in FIG. 9 to unlock the lock 29 and open the lid 22 as shown in FIG. 6.

The top opening 21 of the container 14 when the lid 22 is opened thus is presented for receiving diverted bills discharged by the conveyor 10 at the divert discharge end 13 of the conveyor.

An angular metal shroud generally indicated at 55 having a top wall 56, a side wall 57 and end walls 58 and 59 (FIGS. 3 and 5) is mounted on the unit frame to cover the divert end 13 of the conveyor 10. The upper end of the container 14 when open, thus is protected against access by any person, whether or not authorized, so as to prevent fishing of bills discharged into the container 14 while the container is open even though locked to the unit. The shroud 55 may be mounted on the unit by an angular tab 60 projecting through the shroud end wall 59 and by a screw 61 extending through the shroud end wall 58 and engaged in a threaded opening 62 in the bracket plate 42 on which the key retainer 41 is mounted (FIGS. 7 and 10). Shroud 55 is sealed to the unit by wire and lead seal 63 engaged through an opening in shroud end wall 58 and an aligned opening 64 in bracket plate 42.

A container 14 filled with diverted currency can only be removed from the ATM unit by actuating the key 40 to close the lid 22 and lock the container lock 29, when the key 40 may be axially withdrawn from the lock 29 to the position shown in FIG. 7. At this time, the container 14 is released from locked connection with the ATM unit and may be manipulated by handle 14*a* to disengage container 14 from the angle bracket 53 and the bracket flange 51. When released, it may be transported by a transport guard to the central bank where the container 14 may be opened by the twin of key 40 located at the bank.

A fundamental purpose or objective of the invention is to control access, by personnel servicing ATM's or others, to diverted bills during delivery to, deposit in and storing of such bills in a container for transportation of such bills in sealed, tamper-indicating condition in said container from a remote ATM to a central bank. Such personnel may involve individuals who may be carrying out servicing, adjusting or other maintenance or repair tasks upon any part or portion of the remotely located ATM and, thus, may have access generally to the interior of and devices located in the housing of the ATM 1.

Such personnel are entirely different from the usual bonded transport guards that may transport banking media in armored cars from one to another protected banking facility. It is possible to identify transport guards who are handling sealed containers if any tampering with such containers during such transportation is discovered.

Fundamental characterizing features of the concepts of the invention, which combine to provide maximum security for diverted bills collected in a divert container component of an ATM, include, the location of a container opening, when the closure for the opening is in open position, immediately adjacent the discharge end of conveyor means which delivers diverted bills to the container; the shrouded enclosure both of the divert delivery end of the conveyor and of the container opening; the locking of the container to the ATM unit when the container closure is in open position; the use of a key captively mounted on the ATM to actuate a container closure lock and to actuate through the lock, said closure between closed and open position as the lock changes from locked to unlocked mode, respectively, and vice versa; the securing of the container when mounted on the ATM against removal by the trapped key engagement with the container lock when the latter is in unlocked condition; the provision of retaining and positioning means locating the container when assembled with the ATM in position for actuating the container lock by the trapped key, the positioning being such that the shrouded enclosure protects the container closure and lock against fishing access to the interior of the container; and the location of the container lock mechanism inside the container when the closure is closed and locked by the lock.

The cooperative interrelation of the components which provide these features combine to provide a truly sealed, tamper-indicating container construction for assembly with an ATM, which container receives and stores diverted bills while assembled with the ATM, and also transports the bills to a central bank from the ATM, under conditions of maximum security.

For example, the shroud means, container assembly orientation and retention means, the cooperative positioning of the trapped key and container when assembled to the ATM, and the location of the container lock mechanism within the container, all contribute to providing a greater degree of security for bills received and stored in the container at all times, than the security provided by the divert container construction of U.S. Pat. No. 4,154,437.

Accordingly, the new construction satisfies the stated objectives and solves problems and answers needs that have existed in the art.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact detail shown or described.

Having now described the features, principles and cooperative relationships of the new structures, and the advantageous, new and useful results obtained, the new structures, devices, components, elements, arrangements, parts, combinations and relationships are set forth in the appended claims.

We claim:

1. In a cash dispensing automatic banking machine having a conveyor which transports paper money bills diverted from the normal path of travel to a conveyor divert discharge station, the combination of a container having walls forming a bill-receiving opening provided with a closure lid; lock means mounted on a container wall having bolt means located inside the container cooperatively connected with the closure lid for moving the closure lid from closed to open position as the bolt means is actuated from locked to unlocked mode, and vice-versa, and the lock means having a key opening accessible exteriorly of the container; key means including a key for the lock means movably mounted on and sealed to the banking machine; means for mounting and retaining said container in position on the banking machine oriented to telescopically receive in said key opening said key for unlocking said lock means, and when so oriented to locate the container opening and its said closure lid adjacent to said conveyor divert discharge station; and shroud means mounted on the banking machine protectively enclosing said conveyor divert discharge station and said container opening and closure lid when the container is in retained oriented position.

2. The construction defined in claim 1 in which said key means holds the container locked to the banking machine when said key is telescoped in said lock means with the lock means actuated to unlocked mode.

3. The construction defined in claim 2 in which the closure lid is pivotally mounted on the container, and in which the container and closure lid each have flanges overlapping portions of the other.

4. The construction defined in claim 2 in which the lock bolt means includes a rotary bolt, and in which the rotary bolt is connected with the closure lid by pivotally connected lever and link means for moving the closure lid between closed and open positions.

5. The construction defined in claim 2 in which said key is held in a rotatable key retainer rotatably and axially movably mounted on a frame plate of the banking machine, and in which said key and key retainer are sealed against removal from said frame plate.

6. The construction defined in claim 5 in which said frame plate has an opening, in which said key has a lock barrel which extends through the key retainer, in which the key retainer comprises a cylindrical barrel flanged at one end with the barrel extending through said frame plate opening, in which the key retainer barrel flange is engageable with said frame plate to prevent removal of the key retainer from the frame plate by axial movement of the key retainer in one direction, in which pin means extends through the key and key retainer and at least one end of said pin means projects radially from the key retainer barrel, in which the projecting pin end is engageable with said frame plate to prevent removal of the key retainer from the frame plate by movement of the key retainer in the other axial direction, and in which tamper-indicating seal means extends through said pin means, key and key retainer.

7. The construction defined in claim 6 in which the key lock barrel telescopes into said key opening and rotates within the lock means to actuate the bolt means to move the closure lid between closed and open positions.

8. The construction defined in claim 2 in which the means for mounting and retaining said container in oriented position on the banking machine includes spaced flanged brackets on the machine frame engaging side, end, and bottom walls of the container at spaced locations below said container opening to orient the container for telescopically receiving said key; in which U-shaped retainer strip means is mounted on the machine frame and surrounds the end of the container provided with the opening to assist said brackets in holding the container in oriented position; and in which the end of the container provided with the opening must be slipped within said U-shaped retainer strip means in order to engage the container with said flanged brackets in oriented position.

* * * * *